US009150029B1

(12) United States Patent
Kamo

(10) Patent No.: US 9,150,029 B1
(45) Date of Patent: Oct. 6, 2015

(54) LIQUID EJECTION DEVICE

(71) Applicant: BROTHER KOGYO KABUSHIKI KAISHA, Nagoya-shi, Aichi-ken (JP)

(72) Inventor: Masahiko Kamo, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/645,599

(22) Filed: Mar. 12, 2015

(30) Foreign Application Priority Data

Mar. 12, 2014 (JP) ..... 2014-048832

(51) Int. Cl.
*B41J 2/19* (2006.01)
*B41J 2/20* (2006.01)
*B41J 2/18* (2006.01)

(52) U.S. Cl.
CPC .... *B41J 2/19* (2013.01); *B41J 2/20* (2013.01); *B41J 2/18* (2013.01); *B41J 2202/07* (2013.01)

(58) Field of Classification Search
CPC ..... B41J 2/19; B41J 2/20; B41J 2/18; B41J 2202/07
USPC ..... 347/92, 94, 84
See application file for complete search history.

(56) References Cited

U.S. PATENT DOCUMENTS

| | | | | |
|---|---|---|---|---|
| 6,007,193 | A * | 12/1999 | Kashimura et al. | 347/92 |
| 2002/0047882 | A1 * | 4/2002 | Karlinski et al. | 347/85 |
| 2002/0097307 | A1 * | 7/2002 | Tsukuda | 347/93 |
| 2008/0174645 | A1 * | 7/2008 | Umeda et al. | 347/92 |
| 2009/0073217 | A1 * | 3/2009 | Yaneda | 347/30 |
| 2009/0309917 | A1 | 12/2009 | Inada et al. | |
| 2013/0233418 | A1 * | 9/2013 | Aldrich et al. | 137/560 |

FOREIGN PATENT DOCUMENTS

| | | |
|---|---|---|
| JP | 2010-018027 | 1/2010 |
| JP | 4985639 | 7/2012 |

* cited by examiner

*Primary Examiner* — Henok Legesse
(74) *Attorney, Agent, or Firm* — Frommer Lawrence & Haug LLP

(57) ABSTRACT

An ink ejection device includes: a head section ejecting a plurality of kinds of inks; and an ink supply section supplying the plurality of kinds of inks to the head section. The ink supply section includes: two outlet ports which are separated from each other in a first direction intersecting with a vertical direction and through which a first kind of ink among the plurality of kinds of inks is supplied toward the head section; and an air-trap chamber in communication with the two outlet ports. The air-trap chamber protrudes to one side of a second direction intersecting with the vertical direction and the first direction relative to the two outlet ports. A portion connecting the two outlet ports of the air-trap chamber has an arc shape in a plane containing the first direction and the second direction or a bent portion of the portion connecting the two outlet ports of the air-trap chamber has an obtuse angle in the plane.

18 Claims, 8 Drawing Sheets

LIQUID EJECTION DEVICE

CROSS-REFERENCE TO RELATED APPLICATIONS

This non-provisional application claims priority under 35 U.S.C. §119(a) on Patent Application No. 2014-048832 filed in Japan on Mar. 12, 2014, the entire contents of which are hereby incorporated by reference.

TECHNICAL FIELD

The present invention relates to a liquid ejection device.

BACKGROUND

As an example of a liquid ejection device, an ink jet printer is known. The ink jet printer includes: an ink jet head (a liquid ejection section) ejecting an ink; and a buffer tank (a liquid supply section) arranged above the ink jet head and supplying the ink to the ink jet head.

The buffer tank is connected to four ink tanks through tubes and then receives inks of four colors supplied from the four ink tanks. The buffer tank includes four air-trap chambers corresponding to the inks of four colors. The air-trap chamber for yellow ink is formed in a U-shape having two right-angled corner portions. Further, the air-trap chamber for cyan ink is formed in a U-shape having two right-angled corner portions, along the air-trap chamber for yellow ink.

The ink in the buffer tank is supplied to the ink jet head after the air is separated and removed in the air-trap chamber. The air collected in the upper portion of the air-trap chamber is discharged to the outside through an air discharge section connected to the air-trap chamber.

SUMMARY

In the above-described ink jet printer, the air-trap chamber for yellow ink and the air-trap chamber for cyan ink are formed in a U-shape having two right-angled corner portions when viewed from the up-down direction. Thus, there has been a problem that air is easily collected in the corner portions and hence an unsatisfactory air discharge property is caused.

An object of the present disclosure is to provide a liquid ejection device in which gas separated from liquid in an air-trap chamber is easily discharged from the air-trap chamber.

The liquid ejection device according to a first aspect is a liquid ejection device comprising: a liquid ejection section including a plurality of nozzles and being configured to eject a plurality of kinds of liquids, each of the nozzles being configured to eject one kind of liquid among the plurality of kinds of liquids; and a liquid supply section configured to supply the plurality of kinds of liquids to the liquid ejection section, wherein the liquid supply section includes: two first outlet ports which are separated from each other in a first direction intersecting with a vertical direction and through which a first kind of liquid among the plurality of kinds of liquids flows toward the liquid ejection section; a first air-trap chamber which communicates with the two first outlet ports and which protrudes to one side of a second direction intersecting with the vertical direction and the first direction relative to the two first outlet ports; a first liquid introduction passage connected to the first air-trap chamber; and a first air discharge passage connected to the first air-trap chamber, and wherein a portion, connecting the two first outlet ports, of the first air-trap chamber has an arc shape in a plane containing the first direction and the second direction or a bent portion of the portion, connecting the two first outlet ports, of the first air-trap chamber has an obtuse angle in the plane.

The above and further objects and features will more fully be apparent from the following detailed description with accompanying drawings.

DETAILED DESCRIPTION

Figure 1:
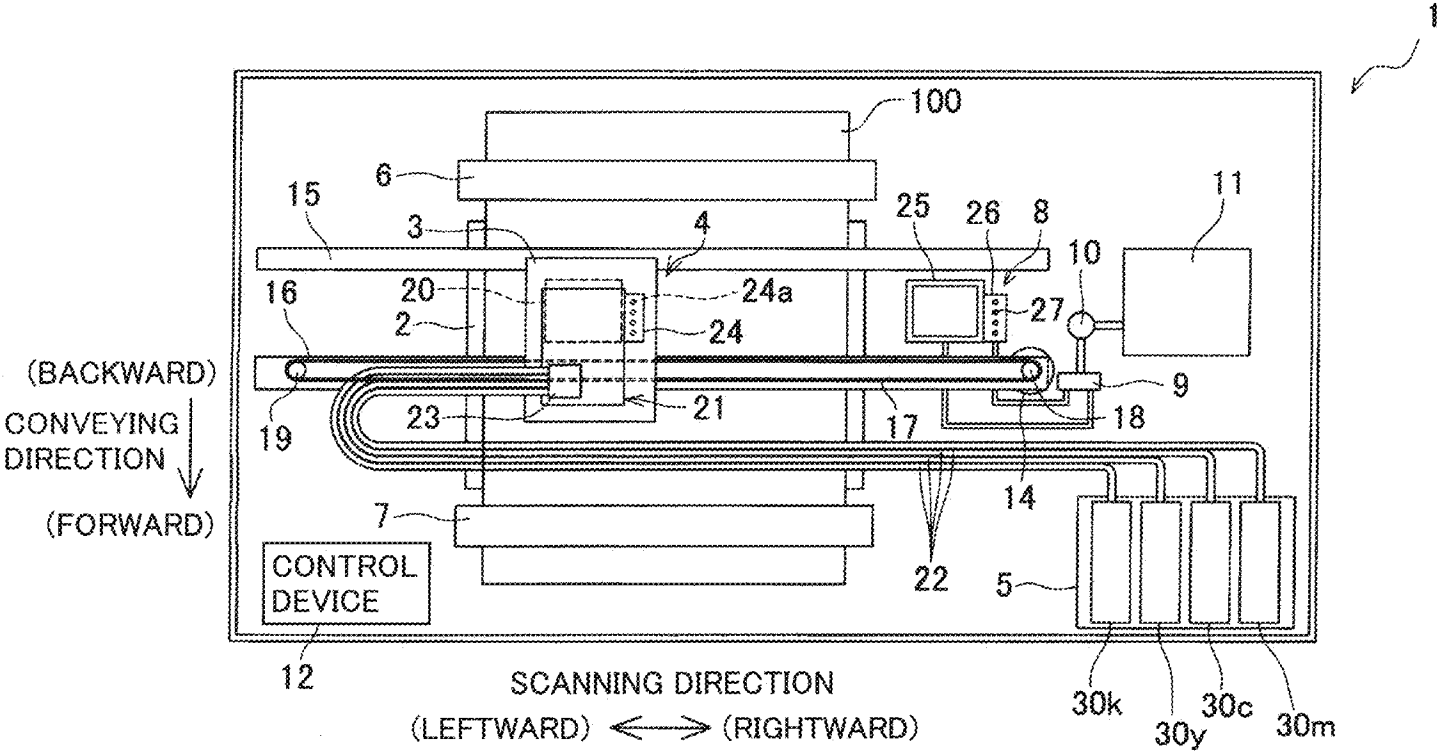
FIG. 1 is a schematic plan view of a printer according to the present embodiment.

The present embodiment is described below. FIG. 1 is a schematic plan view of a printer according to the present embodiment.

(Outline Configuration of Printer)

As illustrated in FIG. 1, a printer 1 comprises a platen 2, a carriage 3, an ink ejection device 4, a holder 5, a paper feed roller 6, a paper discharge roller 7, a cap device 8, a switching device 9, a suction pump 10, a waste liquid tank 11, and a control device 12. In the following description, the forward and the backward as well as the rightward and the leftward illustrated in FIG. 1 are respectively referred to as the "forward", the "backward", the "rightward", and the "leftward" of the printer 1. The "upward" of the printer 1 is defined as an ink ejection side and the "downward" of the printer 1 is defined as a side where ink is ejected. The following description is given by using these definitions of directions: forward, backward, rightward, leftward, upward, and downward.

A recording paper sheet 100 serving as a recording medium is placed on the upper surface of the platen 2. Further, above the platen 2, two guide rails 15 and 16 are provided that extend in parallel to a right-left direction (also referred to as a scanning direction) in FIG. 1.

The carriage 3 is attached to the two guide rails 15 and 16 and movable along the two guide rails 15 and 16 in the scanning direction in a region opposing the platen 2. Further, a drive belt 17 is attached to the carriage 3. The drive belt 17 is an endless-shaped belt wound around two pulleys 18 and 19. The pulley 18 is linked to a carriage drive motor 14. The carriage drive motor 14 rotationally drives the pulley 18 so as to run the drive belt 17, and thus, the carriage 3 is reciprocated in the scanning direction.

The ink ejection device 4 (a liquid ejection device) is mounted on the carriage 3. The ink ejection device 4 includes a head section 20 (a liquid ejection section) and an ink supply section 21 (a liquid supply section). Further, four ink cartridges 30 respectively storing inks of four colors (black, yellow, cyan, and magenta) are detachably mounted on the holder 5. In the following description, components of the printer 1 corresponding to the inks of black (K), yellow (Y), cyan (C), and magenta (M) are designated respectively by reference numerals obtained by suitably appending "k" indicating black, "y" indicating yellow, "c" indicating cyan, and "m" indicating magenta to the reference numerals indicating these components so that correspondence to inks is expressed. For example, an ink cartridge 30*k* indicates an ink cartridge 30 storing black ink. Further, inks of three colors consisting of yellow, cyan, and magenta other than black ink are generically referred to as "color inks", in some cases.

Figure 5:
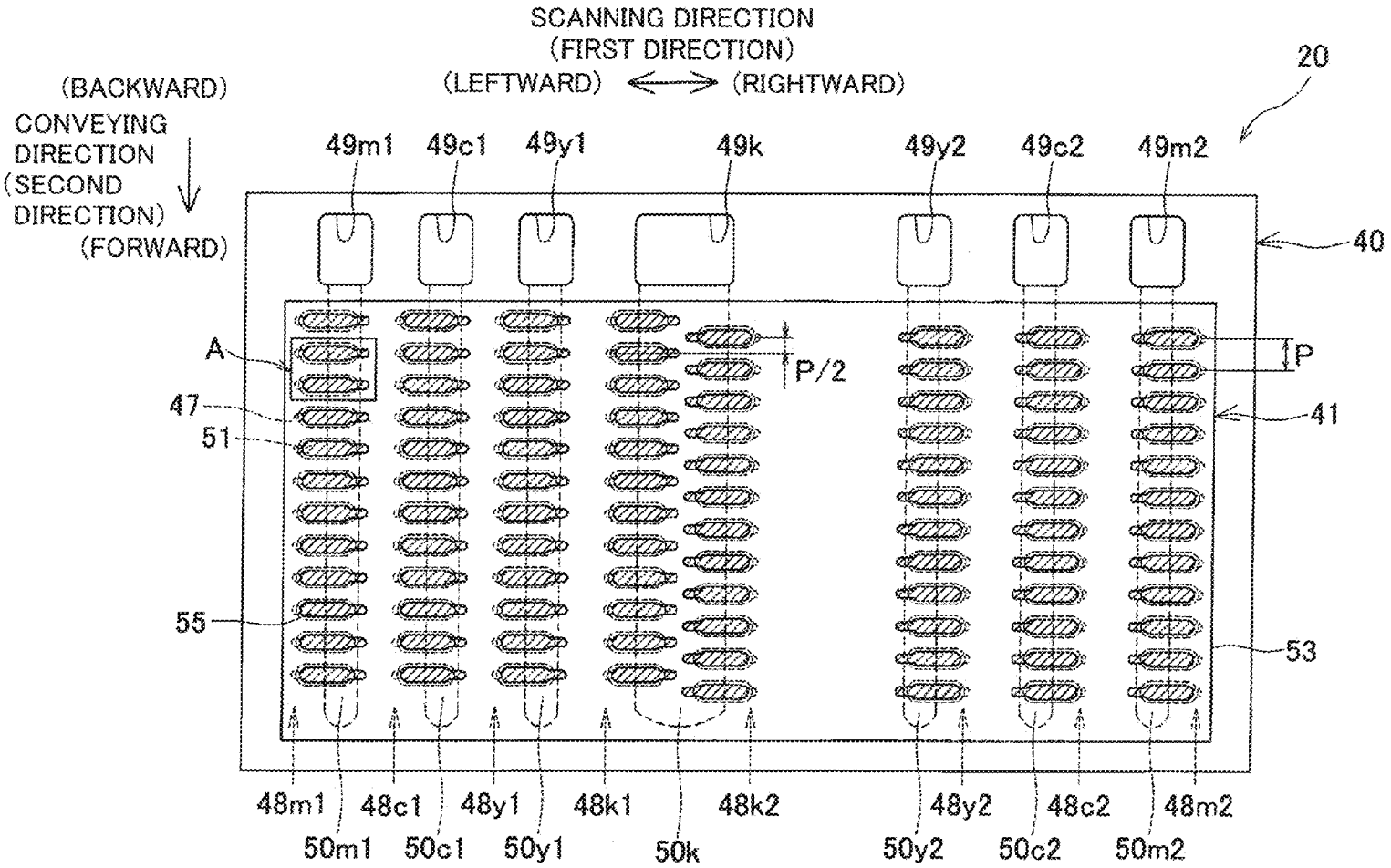
FIG. 5 is a top view of a head section.
Figure 6A:
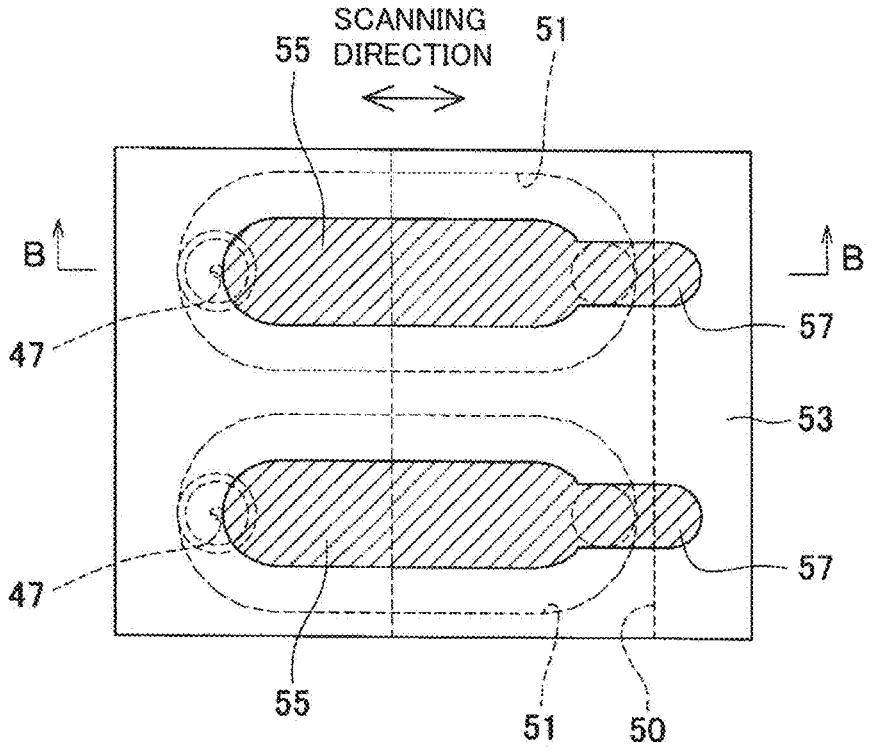
FIG. 6A is an enlarged view of part A in FIG. 5.
Figure 6B:
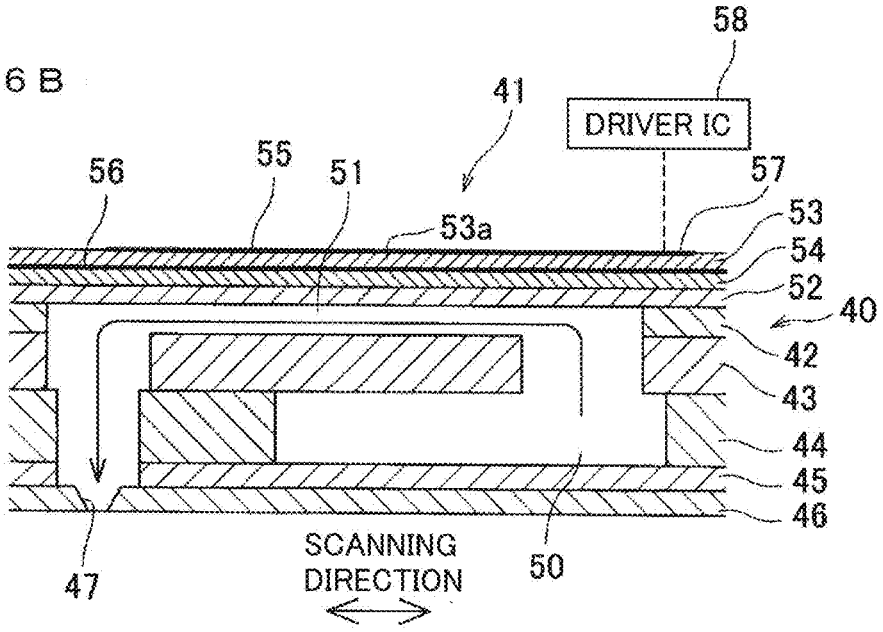
FIG. 6B is a sectional view taken along line B-B in FIG. 6A.

The head section 20 includes a plurality of nozzles 47 formed in a lower surface thereof (see FIGS. 5, 6A, and 6B). Then, inks are ejected through the nozzles 47. Details of the passage structure and the like of the head section 20 are described later.

The ink supply section 21 is arranged above the head section 20 and supplies the inks of four colors to the head section 20. The ink supply section 21 is connected through a tube joint 23 to four tubes 22 connected to the holder 5.

Further, the ink supply section 21 is provided with an air discharge unit 24. The air discharge unit 24 is configured to discharge air present in the ink passage of the ink supply section 21, before the air moves to the head section 20.

The ink passages for the inks of four colors formed in the ink supply section 21 are respectively connected to four air discharge ports 24*a* of the air discharge unit 24. Here, each air discharge port 24*a* is provided with a valve (not illustrated) for switching connection/disconnection to/from the outside.

The paper feed roller 6 and the paper discharge roller 7 are rotationally driven by a motor (not illustrated) in synchronization with each other. The paper feed roller 6 and the paper discharge roller 7 convey the recording paper sheet 100 placed on the platen 2 in the conveying direction (forward) illustrated in FIG. 1, in cooperation with each other.

Then, the printer 1 prints a desired image or the like on the recording paper sheet 100 by ejecting the inks through the plurality of nozzles 47 of the head section 20 while conveying the recording paper sheet 100 in the conveying direction by the paper feed roller 6 and the paper discharge roller 7 and while moving the ink ejection device 4 together with the carriage 3 in the scanning direction.

The cap device 8 is arranged at a position on one side (the right side) of the platen 2 in the scanning direction. The cap device 8 includes a nozzle cap 25 and an air discharge cap 26. Further, the cap device 8 is driven by a cap raising/lowering mechanism (not illustrated), to be raised and lowered in an up-down direction (a direction perpendicular to the paper of FIG. 1, and a vertical direction).

When the carriage 3 moves to the right side of the platen 2, the nozzle cap 25 opposes the lower surface of the head section 20 and the air discharge cap 26 opposes the four air discharge ports 24*a* of the air discharge unit 24. In this state, when the cap device 8 is raised, the cap device 8 is attached to the ink ejection device 4. At that time, the nozzle cap 25 covers the plurality of nozzles 47 of the head section 20 and the air discharge cap 26 is connected to the four air discharge ports 24*a* of the air discharge unit 24. The air discharge cap 26 is provided with four rod-shaped opening/closing members 27 for respectively opening/closing the valves provided in the four air discharge ports 24*a*. Although detailed description is not given, in a state that the air discharge cap 26 is connected to the four air discharge ports 24*a*, the four rod-shaped opening/closing members 27 are driven up and down by a drive mechanism (not illustrated) and thereby inserted into the air discharge ports 24*a* from below so as to drive the valves provided therein.

The nozzle cap 25 and the air discharge cap 26 are connected through the switching device 9 to the suction pump 10. The connection of the suction pump 10 is switched by the switching device 9 to the nozzle cap 25 or the air discharge cap 26 and thereby allows selective execution of suction purge and air discharging purge described below.

(Suction Purge)

In a state that the nozzle cap 25 covers the plurality of nozzles 47 of the head section 20, the pressure in the nozzle cap 25 is reduced by the suction pump 10 so that inks are suctioned and discharged respectively through the plurality of nozzles 47. In this manner, foreign substances, air bubbles, or the ink having a viscosity increased by drying are discharged out of the head section 20.

(Air Discharging Purge)

In a state that the air discharge cap 26 is connected to the air discharge ports 24*a* and that the valves provided in the air discharge ports 24*a* are opened by the opening/closing members 27, a negative pressure is applied on the air discharge ports 24*a* by the suction pump 10. By virtue of this, air in the ink supply section 21 is discharged through the air discharge ports 24*a* before moving to the head section 20.

Here, at the time of suction purge or air discharging purge, the inks discharged from the head section 20 or the ink supply section 21 of the ink ejection device 4 are sent to the waste liquid tank 11 connected to the suction pump 10.

The control device 12 controls the above-described various parts of the printer 1 so as to execute various kinds of processing such as printing on the recording paper sheet 100. For example, on the basis of a print instruction transmitted from an external device such as a personal computer, the control device 12 controls the ink ejection device 4, the carriage drive motor 14, and the like, so as to print an image or the like on the recording paper sheet 100. Further, the control device 12 controls the switching device 9, the suction pump 10, and the like, so as to execute suction purge or air discharging purge described above.

(Details of Ink Ejection Device)

Figure 2:
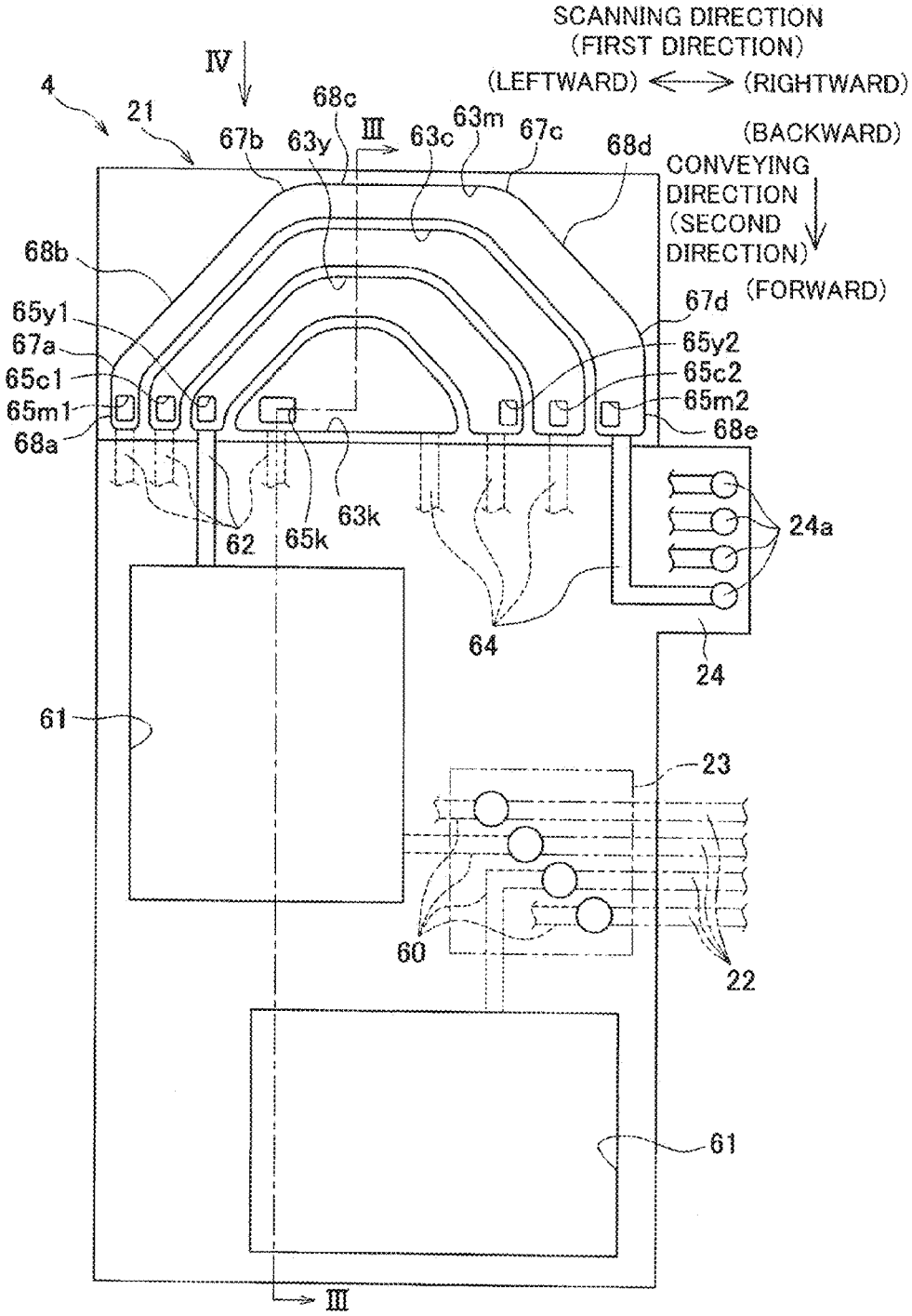
FIG. 2 is a top view of an ink ejection device.
Figure 3:
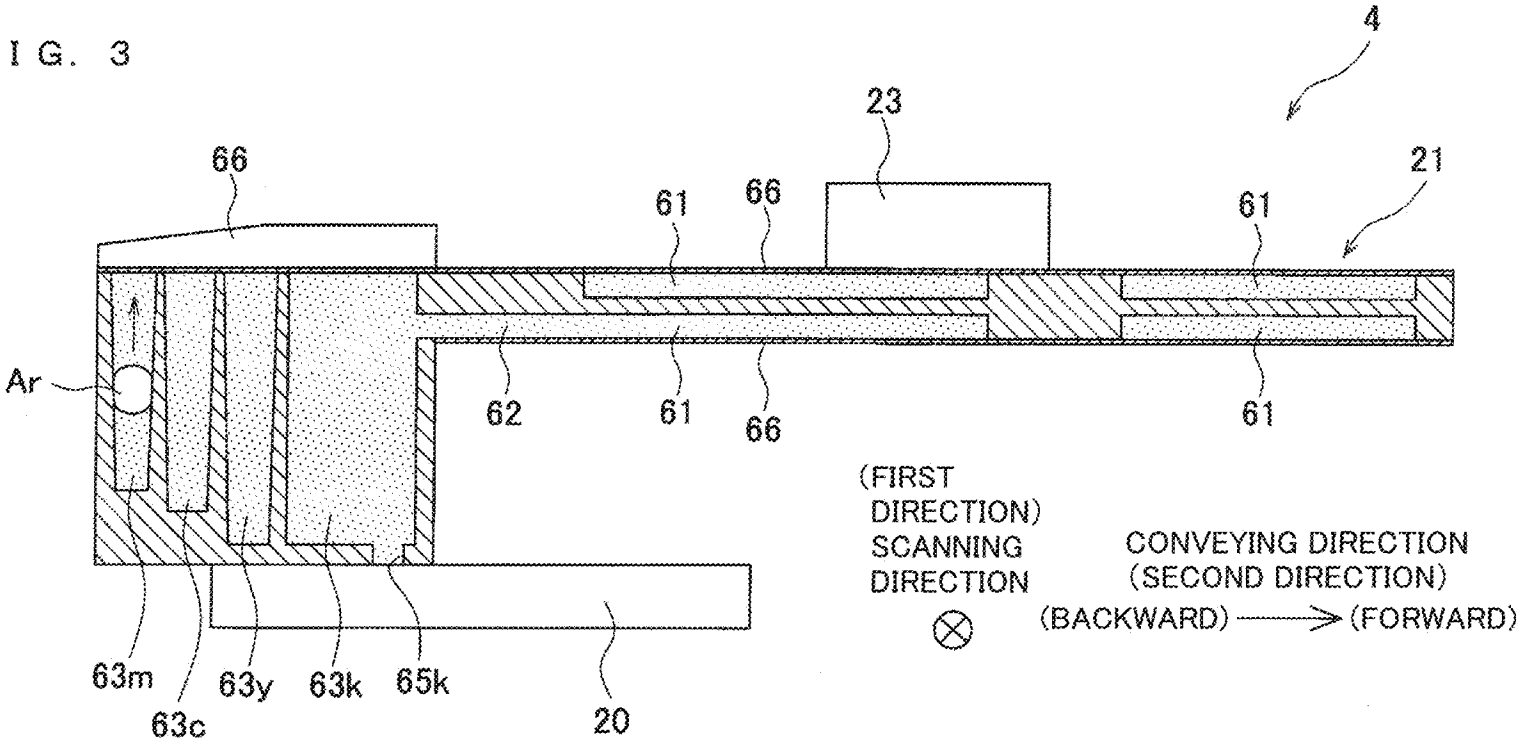
FIG. 3 is a sectional view taken along line in FIG. 2.
Figure 4:
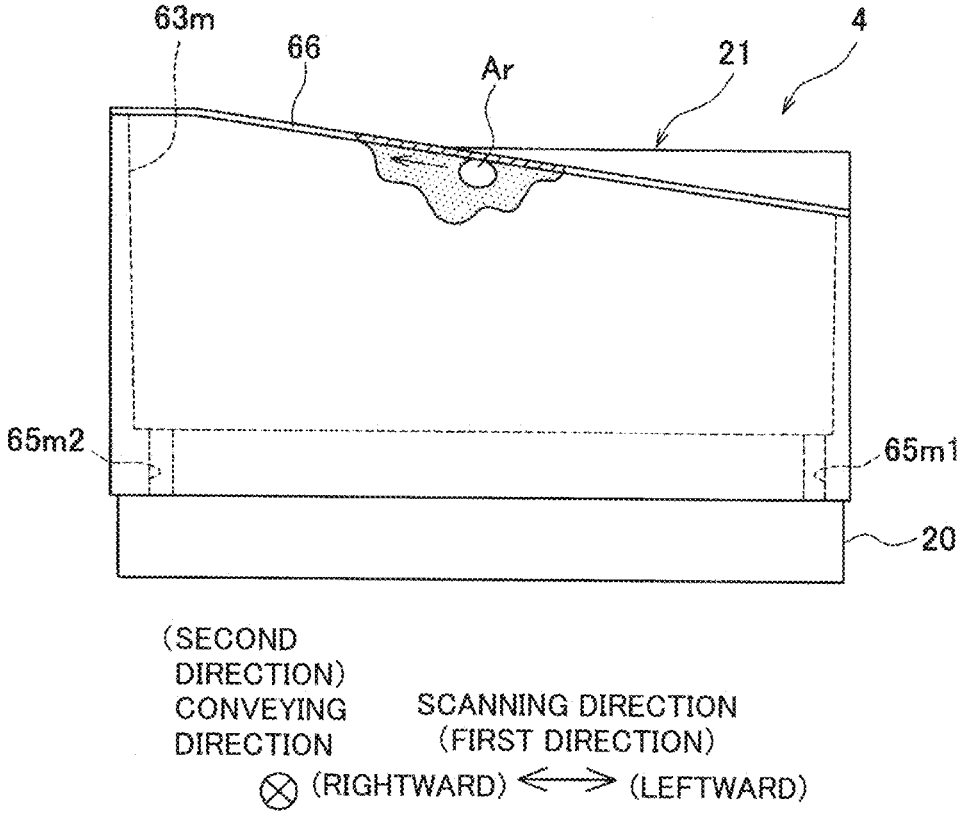
FIG. 4 is a view taken in a direction of arrow IV in FIG. 2.

Next, details of the configuration of the ink ejection device 4 are described below. FIG. 2 is a top view of the ink ejection device 4 to which a film 66 described later is not attached. Here, in FIG. 2, the tubes 22 and the tube joint 23 are indicated by dashed double-dotted lines. FIG. 3 is a sectional view taken along line III-III in FIG. 2. Here, in FIG. 3, the film 66 and the tube joint 23 are indicated by solid lines. Further, in FIG. 3, for simplicity of the drawing, the ink supply section 21 alone is illustrated in sectional view and the head section 20 is illustrated in side view. FIG. 4 is a view taken in a direction of arrow IV in FIG. 2. Here, in FIG. 4, the film 66 is illustrated with solid lines. As described above, the ink ejection device 4 includes: the head section 20; and the ink supply section 21 arranged above the head section 20.

(Configuration of Head Section)

First, the configuration of the head section 20 is described below. FIG. 5 is a top view of the head section 20. FIG. 6A is an enlarged view of part A in FIG. 5. FIG. 6B is a sectional view taken along line B-B in FIG. 6A. As illustrated in FIGS. 5 and 6B, the head section 20 includes a passage unit 40 and a piezoelectric actuator 41.

(Passage Unit)

As illustrated in FIG. 6B, the passage unit 40 has a structure in which five plates 42 to 46 are stacked on one another. The lowermost plate 46 among the five plates 42 to 46 is a nozzle plate in which the plurality of nozzles 47 are formed. On the other hand, in the remaining four plates 42 to 45 on the upper side, passages such as manifolds 50 and pressure chambers 51 in communication with the plurality of nozzles 47 are formed.

With reference mainly to FIG. 5, the arrangement of the plurality of nozzles 47 formed in the nozzle plate 46 is described below. In the nozzle plate 46, the plurality of nozzles 47 are arranged with a pitch P along a direction (a second direction) parallel to the conveying direction. The plurality of nozzles 47 constitute a total of eight nozzle groups 48 aligned in the scanning direction (a first direction). Here, in the present embodiment, the direction (the second direction) of arrangement of the plurality of nozzles 47 is perpendicular to the scanning direction (the first direction). However, this configuration is not indispensable. That is, the direction of arrangement of the nozzles 47 may intersect with the scanning direction at an angle other than 90 degrees.

The eight nozzle groups 48 consist of two nozzle groups 48*k*1 and 48*k*2 for ejecting black ink, two nozzle groups 48*y*1 and 48*y*2 for ejecting yellow ink, two nozzle groups 48*c*1 and 48*c*2 for ejecting cyan ink, and two nozzle groups 48*m*1 and 48*m*2 for ejecting magenta ink. Here, between the two nozzle groups 48 for ejecting the ink of the same color (for example, between the two nozzle groups 48*k*1 and 48*k*2), the positions of the nozzles 47 in the direction of arrangement of the nozzles are shifted by a half of the pitch P employed in each nozzle group 48 (i.e., by P/2).

The two nozzle groups 48*k*1 and 48*k*2 for black ink are arranged adjacent to each other in a center portion in the scanning direction. Then, the two nozzle groups 48*y*1 and 48*y*2 for yellow ink are arranged on both sides of the two nozzle groups 48*k*1 and 48*k*2 for black ink in the scanning direction in a manner that the two nozzle groups 48*k*1 and 48*k*2 are located therebetween. The two nozzle groups 48*c*1 and 48*c*2 for cyan ink are arranged on both sides of the four nozzle groups 48*k*1, 48*k*2, 48*y*1 and 48*y*2. Further, the two nozzle groups 48*m*1 and 48*m*2 for magenta ink are arranged on both sides of the six nozzle groups 48*k*1, 48*k*2, 48*y*1, 48*y*2, 48*c*1 and 48*c*2. That is, arrangement of the nozzle groups 48 for the inks of four colors consisting of black, yellow, cyan, and magenta is bilaterally symmetric in the scanning direction.

Thus, in so-called bidirectional printing, the four nozzle groups 48 each arranged on the left side and on the right side are used selectively at the time that the carriage 3 moves in one of the scanning direction and at the time that it moves in the other of the scanning direction. By virtue of this, the inks of the four colors are jetted onto the recording paper sheet 100 always in the same order (namely, in the order of magenta, cyan, yellow and black) to form each dot, regardless of the direction the carriage 3 moves. That is, since the nozzles are arranged in the above-described manner, while employing the bidirectional printing having a merit of a high recording speed, a high quality image or the like can be recorded by making uniform the shade of color in respective dots.

Here, the arrangement of the nozzle groups 48*m*, 48*c*, and 48*y* for the color inks of three colors arranged separately onto each of the right and left sides of the nozzle groups 48*k* for black ink is not limited to a bilaterally symmetric arrangement like that of FIG. 5 and may be modified suitably. For example, on both of the left side and the right side of the nozzle groups 48*k* for black ink, the nozzle groups 48*m*, 48*c*, and 48*y* for the color inks of three colors may be arranged in the order of magenta→cyan→yellow from the left.

Next, the structure of the passages formed in the four plates 42 to 45 on the upper side of the passage unit 40 and formed in communication with the plurality of nozzles 47 is described below. First, as illustrated in FIG. 5, seven supply ports 49 aligned in the scanning direction are formed in the upper surface of the end part of the passage unit 40 on the upstream side of the conveying direction. These supply ports 49 receive the inks of four colors supplied from the ink supply section 21 described later. The seven supply ports 49 consist of a supply port 49*k* for black ink, two supply ports 49*y*1 and 49*y*2 for yellow ink, two supply ports 49*c*1 and 49*c*2 for cyan ink, and two supply ports 49*m*1 and 49*m*2 for magenta ink. Here, FIG. 5 illustrates a mode that the seven supply ports 49 of the head section 20 are linearly aligned on a plane. However, employable configurations are not limited to this arrangement. For example, the positions of the seven supply ports 49 may be slightly different from each other in the up-down direction. Further, the seven supply ports 49 may be aligned along a direction slightly inclined relative to the horizontal direction.

The seven supply ports 49 are aligned in the scanning direction in the order corresponding to the above-described arrangement of the nozzle groups 48 for the inks of four colors. Specifically, the supply port 49*k* for black ink is first arranged in a center portion in the scanning direction. Then, on the outer sides (on each of the right and left sides) of the supply port 49*k* for black ink in the scanning direction, the supply port 49*y* for yellow ink, the supply port 49*c* for cyan ink and the supply port 49*m* for magenta ink are arranged in this order to be in bilateral symmetry in the scanning direction. That is, the two supply ports 49*y* for yellow ink are arranged in a manner that the supply port 49*k* for black ink is located therebetween in the scanning direction. Then, the two supply ports 49*c* for cyan ink are arranged in a manner that the three supply ports 49*k* and 49*y* are located therebetween in the scanning direction. Further, the two supply ports 49*m* for magenta ink are arranged in a manner that the five supply ports 49*k*, 49*y*, and 49*c* are located therebetween in the scanning direction. Here, the supply port 49*k* for black ink has a hole with a larger size than those of the other six supply ports 49 because the black ink is to be supplied therethrough to both of the two nozzle groups 48*k*1 and 48*k*2.

Further, in the passage unit 40, seven manifolds 50 are formed that extend respectively in the conveying direction. The backward end parts of the seven manifolds 50 are respectively connected to the seven supply ports 49. The manifold 50*k* receives black ink supplied through the supply port 49*k*. Further, the manifolds 50*y*1 and 50*y*2 receive yellow ink supplied through the supply ports 49*y*1 and 49*y*2. The manifolds 50*c*1 and 50*c*2 receive cyan ink supplied through the supply ports 49*c*1 and 49*c*2. The manifolds 50*m*1 and 50*m*2 receive magenta ink supplied through the supply ports 49*m*1 and 49*m*2. Here, as for the passage for black ink, similarly to the passages for the other inks, two supply ports 49*k* may be provided respectively in correspondence to the two nozzle groups 48*k*1 and 48*k*2 and, similarly, two manifolds 50*k* may be provided.

The manifolds 50 for inks of four colors consisting of black, yellow, cyan, and magenta are arranged in bilateral symmetry in the scanning direction, similarly to the above-described nozzle groups 48 for the inks of four colors. That is, the manifold 50*k* for black ink is arranged in a center portion in the scanning direction. Then, the two manifolds 50*y*1 and 50*y*2 for yellow ink are arranged on both sides of the manifold 50*k* in a manner that the manifold 50*k* is located therebetween. The two manifolds 50*c*1 and 50*c*2 for cyan ink are arranged on both sides of the manifolds 50*k*, 50*y*, and the two manifolds 50*m*1 and 50*m*2 for magenta ink are arranged on both sides of the manifolds 50*k*, 50*y*, 50*c*.

Further, the passage unit 40 includes the plurality of pressure chambers 51 respectively corresponding to the plurality of nozzles 47. The plurality of pressure chambers 51 are formed in the plate 42 located as the uppermost layer of the passage unit 40 and arranged respectively in correspondence to the plurality of nozzles 47. As illustrated in FIG. 5, the pressure chambers 51 are arranged at positions above the manifolds 50 in eight rows along the conveying direction respectively in correspondence to the eight nozzle groups 48. Here, the two nozzle groups 48*k*1 and 48*k*2 for black ink are arranged adjacent to each other in the scanning direction. Further, the two rows of the pressure chambers corresponding to the two nozzle groups are also adjacent to each other. Thus, the two rows of the pressure chambers for black ink are both in communication with one manifolds 50*k* located immediately thereunder. On the other hand, each row of pressure chambers corresponding to each of the other nozzle groups 48 are in communication with one manifolds 50 located immediately thereunder. Accordingly, as illustrated with an arrow in FIG. 6B, a plurality of individual passages each branched from each manifold 50, passing through the corresponding pressure chamber 51 and reaching the corresponding nozzle 47 are formed in the passage unit 40.

(Piezoelectric Actuator)

The piezoelectric actuator 41 is joined to the upper surface of the passage unit 40 such as to cover the plurality of pressure chambers 51. As illustrated in FIGS. 5, 6A, and 6B, the piezoelectric actuator 41 includes an ink sealing film 52, two piezoelectric layers 53 and 54, a plurality of individual electrodes 55, and a common electrode 56.

The ink sealing film 52 is a thin film made of a material with a low ink permeability, such as a metal material of stainless steel or the like. The ink sealing film 52 is joined to the upper surface of the passage unit 40 such as to cover the plurality of pressure chambers 51.

The two piezoelectric layers 53 and 54 are respectively made of a piezoelectric material containing, as a main component, lead zirconate titanate which is mixed crystal of lead titanate and lead zirconate. The piezoelectric layers 53 and 54 stacked with each other are arranged on the upper surface of the ink sealing film 52.

The plurality of individual electrodes 55 are arranged on the upper surface of the upper piezoelectric layer 53. More specifically, as illustrated in FIGS. 5, 6A, and 6B, each of the individual electrodes 55 is arranged in a region of the upper surface of the piezoelectric layer 53 that opposes a center portion of the pressure chamber 51. The plurality of individual electrodes 55 are arranged in correspondence to the plurality of pressure chambers 51 and hence constitute a total of eight rows of individual electrodes. An individual terminal 57 extends from each of the individual electrodes 55. The plurality of individual terminals 57 are connected to a wiring member (not illustrated) on which a driver IC 58 is mounted. According to this configuration, the plurality of individual electrodes 55 are electrically connected to the driver IC 58. The driver IC 58 selectively applies, to each of the individual electrodes 55, either a predetermined drive potential or a ground potential.

The common electrode 56 is arranged between the two piezoelectric layers 53 and 54. The common electrode 56 opposes the plurality of individual electrodes 55 with the piezoelectric layer 53 in between. Although illustration of a detailed electric connection structure is not given, a connection terminal extends also from the common electrode 56 onto the upper surface of the piezoelectric layer 53. Then, similarly to the plurality of individual electrodes 55, the connection terminal is connected to a wiring member (not illustrated). The common electrode 56 is connected to a ground wiring formed in the wiring member so that the potential of the common electrode 56 is maintained always at the ground potential.

Here, a portion of the piezoelectric layer 53 (referred to as an active portion 53*a*) located between the individual electrode 55 and the common electrode 56 is polarized in the thickness direction (downward). The active portion 53*a* is a portion where piezoelectric deformation (piezoelectric strain) occurs when a potential difference is caused between the individual electrode 55 and the common electrode 56 to form an electric field in the thickness direction.

The operation of the piezoelectric actuator 41 is described below. When the driver IC 58 applies a drive potential onto a given individual electrode 55, a potential difference is caused between this individual electrode 55 and the common electrode 56. At that time, an electric field is formed in the active portion 53*a* of the piezoelectric layer 53 in the thickness direction (downward). This direction of the electric field accords with the polarization direction of the active portion 53*a*. Thus, the active portion 53*a* is contracted in the surface direction, and in accordance with the contraction of the active portion 53*a*, a deformation so as to be convex toward the pressure chamber 51 is caused in the two piezoelectric layers 53 and 54. This causes a change in the volume of the pressure chamber 51 to generate a pressure wave in the individual passage including the pressure chamber 51, so that ejection energy is applied to the ink for ejecting a droplet of the ink through the nozzle 47.

(Configuration of Ink Supply Section)

Next, the ink supply section 21 is described below. As illustrated in FIG. 3, the tube joint 23 is attached to the upper surface of the ink supply section 21. As illustrated in FIG. 2, in the ink supply section 21, four ink supply passages 60 are formed that are respectively connected through the tube joint 23 to the four tubes 22.

As illustrated in FIGS. 2 and 3, the ink supply section 21 includes four damper chambers 61 respectively connected to the four ink supply passages 60. The four damper chambers 61 respectively correspond to the inks of four colors and are aligned two by two in the up-down direction. The ceiling portions of the two damper chambers 61 on the upper side and the bottom portions of the two damper chambers 61 on the lower side are constructed from films 66 made of resin material and having flexibility. The damper chambers 61 are provided for attenuating a pressure fluctuation in the inks.

As illustrated in FIGS. 2 and 3, the ink supply section 21 is provided with: four air-trap chambers 63 respectively containing the inks of four colors; and four ink introduction passages 62 respectively connecting the four damper chambers 61 and the four air-trap chambers 63 to each other. As illustrated in FIGS. 3 and 4, the ceiling portions of the four air-trap chambers 63 are constructed from the film 66.

The lower wall portion of the ink supply section 21 is provided with: an outlet port 65*k* in communication with the air-trap chamber 63*k* for black ink; two outlet ports 65*y*1 and 65*y*2 in communication with the air-trap chamber 63*y* for yellow ink; two outlet ports 65*c*1 and 65*c*2 in communication with the air-trap chamber 63*c* for cyan ink; and two outlet ports 65*m*1 and 65*m*2 in communication with the air-trap chamber 63*m* for magenta ink. The seven outlet ports 65 are formed at positions immediately above the seven supply ports 49 of the head section 20.

The air-trap chamber 63*y* for yellow ink, the air-trap chamber 63*c* for cyan ink, and the air-trap chamber 63*m* for magenta ink are formed in substantial C-shapes when viewed from the up-down direction (in the horizontal plane). The air-trap chamber 63*y* for yellow ink is arranged along the air-trap chamber 63*k* for black ink such as to cover the air-trap chamber 63*k* from the upstream side of the conveying direction, and in the scanning direction the air-trap chamber 63*k* for black ink is arranged between two portions (both end portions) of the air-trap chamber 63*y* for yellow ink. The air-trap chamber 63*c* for cyan ink is arranged along the air-trap chamber 63*y* for yellow ink such as to cover the air-trap chamber 63*y* from the upstream side of the conveying direction, and in the scanning direction the air-trap chamber 63*y* for yellow ink is arranged between two portions (both end portions) of the air-trap chamber 63*c* for cyan ink. The air-trap chamber 63*m* for magenta ink is arranged along the air-trap chamber 63*c* for cyan ink such as to cover the air-trap chamber 63*c* from the upstream side of the conveying direction and to cover a backward side of the air-trap chamber 63*c* for cyan ink, and in the scanning direction the air-trap chamber 63*c* for cyan ink is arranged between two portions (both end portions) of the air-trap chamber 63*m* for magenta ink.

The two outlet ports 65*y*1 and 65*y*2 for yellow ink are formed in the bottom portions of both end parts (the front-side left end part and the front-side right end part) of the air-trap chamber 63*y* for yellow ink. Thus, a portion connecting the two outlet ports 65*y*1 and 65*y*2 of the air-trap chamber 63*y* for yellow ink has a shape protruding to the upstream side of the conveying direction relative to the two outlet ports 65*y*1 and 65*y*2. In other words, the air-trap chamber 63*y* for yellow ink extends from the left-hand outlet port 65*y*1 to the right-hand outlet port 65*y*2 clockwise with the air-trap chamber 63*k* for black ink as the center. The air-trap chamber 63*c* for cyan ink and the air-trap chamber 63*m* for magenta ink have similar configurations, that is, the two outlet ports 65 are formed in the bottom portions of both end parts (the front-side left end part and the front-side right end part) of each air-trap chamber 63 and then a portion connecting the two outlet ports 65 of each air-trap chamber 63 has a shape protruding to the upstream side of the conveying direction relative to the two outlet ports 65. In other words, the air-trap chambers 63 for cyan ink and for magenta ink extend from the left-hand outlet ports 65 to the right-hand outlet ports 65 clockwise with the air-trap chamber 63*k* for black ink as the center, respectively.

The four ink introduction passages 62 are respectively connected to the front-side left end parts of the four air-trap chambers 63. Further, the ink supply section 21 includes air discharge passages 64 respectively connected to the front-side right end parts of the four air-trap chambers 63. The four air discharge passages 64 are respectively connected to the four air discharge ports 24*a* of the air discharge unit 24.

The front-side left end parts of the air-trap chamber 63*y* for yellow ink, the air-trap chamber 63*c* for cyan ink, and the air-trap chamber 63*m* for magenta ink are located substantially at the same position in the conveying direction. Further, the front-side right end parts of the air-trap chamber 63*y* for yellow ink, the air-trap chamber 63*c* for cyan ink, and the air-trap chamber 63*m* for magenta ink are located substantially at the same position in the conveying direction. Thus, in the air-trap chambers 63*y*, 63*c*, and 63*m* for three color inks, those located on the more downstream side (the more front side) of the conveying direction have the shorter passage length. Here, in the present embodiment, the front-side left end parts and front-side right end parts of the three air-trap chambers 63*y*, 63*c*, and 63*m* are located substantially at the same position in the conveying direction. Instead, the front-side left end parts and the front-side right end parts may be located at different positions from each other.

Bent portions of the portion connecting the two outlet ports 65*m*1 and 65*m*2 of the air-trap chamber 63*m* for magenta ink have only obtuse angles corresponding to angles greater than 90 degrees and smaller than 180 degrees when viewed from the up-down direction (in the horizontal plane). Each end part, of the air-trap chamber 63*m* is provided with a right-angled corner portion formed by R chamfering. As described above, the two outlet ports 65*m*1 and 65*m*2 are formed in both end parts of the air-trap chamber 63*m*. Thus, the portion of the air-trap chamber 63*m* except for both end parts is bent only at obtuse angles in the horizontal plane.

The air-trap chamber 63*m* for magenta ink includes four bent parts 67*a*, 67*b*, 67*c*, and 67*d* having obtuse angles. The four bent parts 67*a*, 67*b*, 67*c*, and 67*d* are aligned in this order from the front-side left end part of the air-trap chamber 63*m* toward the front-side right end part. The four bent parts 67*a*, 67*b*, 67*c*, and 67*d* are formed by R chamfering.

Here, in the present embodiment, the portion 68*a* extending from the front-side left end of the air-trap chamber 63*m* to the bent part 67*a* and the portion 68*e* extending from the front-side right end of the air-trap chamber 63*m* to the bent part 67*d* linearly extend along the conveying direction. However, this configuration is not indispensable. The portions 68*a* and 68*e* may extend in a direction intersecting with the conveying direction as long as the bent parts 67*a* and 67*d* have obtuse angles.

Further, in the present embodiment, the portion 68*b* between the bent part 67*a* and the bent part 67*b* of the air-trap chamber 63*m* and the portion 68*d* between the bent part 67*c* and the bent part 67*d* of the air-trap chamber 63*m* linearly extend in a direction intersecting with both of the conveying direction and the scanning direction. However, this configuration is not indispensable. The portions 68*b* and 68*d* may extend along the conveying direction or the scanning direction as long as the bent parts 67*a*, 67*b*, 67*c*, and 67*d* have obtuse angles. Further, in the present embodiment, each of the portions 68*b* and 68*d* extends in a direction at approximately 45 degrees relative to the conveying direction. However the inclination angle relative to the conveying direction is not limited to this value.

Further, in the present embodiment, the portion 68*c* between the bent part 67*b* and the bent part 67*c* of the air-trap chamber 63*m* linearly extends along the scanning direction. However, this configuration is not indispensable. The portion 68*c* may extend in a direction intersecting with the scanning direction as long as the bent parts 67*b* and 67*c* have obtuse angles.

Similarly to the air-trap chamber 63*m* for magenta ink, bend portions of the portion connecting the two outlet ports 65 of each of the air-trap chamber 63*y* for yellow ink and the air-trap chamber 63*c* for cyan ink have only obtuse angles in the horizontal plane, and the portion connecting the two outlet ports 65 of each of the air-trap chamber 63*y* for yellow ink and the air-trap chamber 63*c* for cyan ink has four bent parts having approximately the same angles as the four bent parts 67*a*, 67*b*, 67*c*, and 67*d* of the air-trap chamber 63*m* for magenta ink.

As illustrated in FIG. 4, the height of the ceiling portion of the air-trap chamber 63*m* for magenta ink increases from the left end part toward the right end part of the air-trap chamber 63*m* along a passage direction of the air-trap chamber 63*m*. Specifically, the heights of the ceiling portions of the portion 68*a* extending from the front-side left end of the air-trap chamber 63*m* to the bent part 67*a* and the portion 68*e* extending from the front-side right end to the bent part 67*d* are respectively at constant. Then, the heights of the ceiling portions of the other portions 68*b*, 68*c*, and 68*d* vary continuously along the passage direction. Similarly to the air-trap chamber 63*m* for magenta ink, the heights of the ceiling portions of the air-trap chamber 63*y* for yellow ink and the air-trap chamber 63*c* for cyan ink respectively increase from the left end part toward the right end part of the air-trap chamber 63.

As illustrated in FIG. 4, the height of the bottom portion of the air-trap chamber 63*m* for magenta ink is at constant. Although not illustrated, similarly to the air-trap chamber

63*m* for magenta ink, the heights of the bottom portions of the air-trap chamber 63*y* for yellow ink and the air-trap chamber 63*c* for cyan ink are at constant.

As illustrated in FIG. 3, as for the lengths of the air-trap chambers 63*y*, 63*c*, and 63*m* for three color inks in the up-down direction, those located on the more upstream side of the conveying direction have the smaller value. That is, the length of the air-trap chamber 63*c* for cyan ink in the up-down direction is greater than the length of the air-trap chamber 63*m* for magenta ink in the up-down direction and smaller than the length of the air-trap chamber 63*y* for yellow ink in the up-down direction. Here, the expression that "the length of the air-trap chamber 63*c* for cyan ink in the up-down direction is greater than the length of the air-trap chamber 63*m* for magenta ink in the up-down direction" indicates that the length in the up-down direction at an arbitrary portion of the air-trap chamber 63*c* for cyan ink is greater than the length in the up-down direction at a portion aligned with the arbitrary portion in the air-trap chamber 63*m* for magenta ink in a passage width direction of the air-trap chamber. Thus, the minimum of the length of the air-trap chamber 63*c* for cyan ink in the up-down direction may be not necessarily greater than the maximum of the length of the air-trap chamber 63*m* for magenta ink in the up-down direction. In the present embodiment, the above-described magnitude relation between the lengths in the up-down direction exists in the entire regions of the air-trap chambers 63*y*, 63*c*, and 63*m* for three color inks in the passage directions (directions extending in a C-shape) thereof.

As illustrated in FIG. 3, horizontal passage widths of the air-trap chambers 63*y*, 63*c*, and 63*m* for three color inks respectively increase upward. Here, each of the horizontal passage widths of the air-trap chambers 63*y*, 63*c*, and 63*m* indicates a width in a direction which is horizontal and perpendicular to the passage direction of each of the air-trap chambers 63*y*, 63*c*, and 63*m*.

As illustrated in FIG. 2, the horizontal passage widths of the air-trap chambers 63*y*, 63*c*, and 63*m* for three color inks respectively increase from the left end part toward the right end part along the passage directions. Specifically, the horizontal passage widths of the three air-trap chambers 63*y*, 63*c*, and 63*m* increase stepwise at each bent part from the left end part toward the right end part.

As illustrated in FIGS. 2 and 3, as for the horizontal passage widths of the air-trap chambers 63*y*, 63*c*, and 63*m*, those located on the more upstream side of the conveying direction have the smaller value. That is, the horizontal passage width of the air-trap chamber 63*c* for cyan ink is greater than the horizontal passage width of the air-trap chamber 63*m* for magenta ink and is smaller than the horizontal passage width of the air-trap chamber 63*y* for yellow ink. Here, the expression that "the horizontal passage width of the air-trap chamber 63*c* for cyan ink is greater than the horizontal passage width of the air-trap chamber 63*m* for magenta ink" indicates that the horizontal passage width at an arbitrary portion of the air-trap chamber 63*c* for cyan ink is greater than the horizontal passage width at a portion aligned with the arbitrary portion in the air-trap chamber 63*m* for magenta ink in the passage width direction. Thus, the minimum of the horizontal passage width of the air-trap chamber 63*c* for cyan ink may be not necessarily greater than the maximum of the horizontal passage width of the air-trap chamber 63*m* for magenta ink. In the present embodiment, the above-described magnitude relation between the horizontal passage widths exists in the entire regions of the air-trap chambers 63*y*, 63*c*, and 63*m* for three color inks in the passage directions (the directions extending in the C-shape) thereof.

Here, the air-trap chambers 63*y*, 63*c*, and 63*m* for three color inks can correspond to the first air-trap chamber. In a case that the air-trap chamber 63*y* for yellow ink corresponds to the first air-trap chamber, the two outlet ports 65*y*1 and 65*y*2 for yellow ink correspond to the two first outlet ports and the ink introduction passage 62 for yellow ink corresponds to the first liquid introduction passage. Further, the air discharge passage 64 for yellow ink corresponds to the first air discharge passage. Also in a case that the air-trap chamber 63*c* for cyan ink and the air-trap chamber 63*m* for magenta ink correspond to the first air-trap chamber, similar correspondence relations exist respectively.

Further, in a case that the air-trap chamber 63*y* for yellow ink corresponds to the first air-trap chamber, the air-trap chamber 63*k* for black ink corresponds to the second air-trap chamber. In a case that the air-trap chamber 63*c* for cyan ink corresponds to the first air-trap chamber, the air-trap chamber 63*k* for black ink and the air-trap chamber 63*y* for yellow ink correspond to the second air-trap chamber. In a case that the air-trap chamber 63*m* for magenta ink corresponds to the first air-trap chamber, the air-trap chamber 63*k* for black ink, the air-trap chamber 63*y* for yellow ink, and the air-trap chamber 63*c* for cyan ink correspond to the second air-trap chamber.

The ink having been sent from the ink cartridge 30 through the tube 22 to the ink supply section 21 flows through the ink supply passage 60, the damper chamber 61, and the ink introduction passage 62 into the air-trap chamber 63 corresponding to the ink. The ink having flowed into the air-trap chamber 63 is supplied through the outlet port 65 to the supply port 49 of the head section 20 located below. Here, when air is mixed in the ink supplied through the tube 22 and then the air flows into the head section 20, this could cause ejection failure in the nozzles 47. In this point, in the present embodiment, the air-trap chamber 63 is present in the upstream of the head section 20. Thus, at that time that the ink flows downward from the air-trap chamber 63 to the supply port 49, the air mixed in the ink is separated from the ink. Thus, the ink from which air has been separated and removed is supplied from the air-trap chamber 63 to the head section 20. Here, the air separated from the ink moves to the upper portion of the air-trap chamber 63 and is then discharged through the air discharge passage 64.

In the present embodiment, the portion connecting the two outlet ports 65 of each of the air-trap chambers 63*y*, 63*c*, and 63*m* for three color inks is bent only at obtuse angles in the horizontal plane. This avoids a situation that gas separated from the ink in each of the air-trap chambers 63*y*, 63*c*, and 63*m* is collected in the bent portion of each of the air-trap chambers 63*y*, 63*c*, and 63*m*. Thus, the gas is easily discharged from the air-trap chambers 63*y*, 63*c*, and 63*m*.

Further, in the present embodiment, in each of the air-trap chambers 63*y*, 63*c*, and 63*m* for three color inks, the ink introduction passage 62 is connected to the front-side left end part and the air discharge passage 64 is connected to the front-side right end part. Thus, the direction in which the air separated from the ink in the vicinity of the outlet port 65 close to the ink introduction passage 62 moves toward the air discharge passage 64 accords with the direction in which the ink having flowed through the ink introduction passage 62 into the air-trap chamber 63 flows toward the outlet port 65 distant from the ink introduction passage 62. Accordingly, the air easily moves toward the air discharge passage 64.

Further, in each of the ceiling portions of the air-trap chambers 63*y*, 63*c*, and 63*m* for three color inks, the height increases from the left end part of the air-trap chamber 63 toward the right end part connected to the air discharge passage 64. Thus, for example, as illustrated in FIG. 4, an air bubble Ar collected in the upper portion of the air-trap chamber 63*m* easily moves rightward (toward the air discharge passage 64) along the ceiling portion of the air-trap chamber 63*m* in accordance with the buoyancy. Thus, air is more easily discharged from the air-trap chambers 63*y*, 63*c*, and 63*m*.

Further, the horizontal passage widths of the air-trap chambers 63*y*, 63*c*, and 63*m* for three color inks respectively increase upward. Thus, for example, as illustrated in FIG. 3, when an air bubble Ar is in contact with both side walls of the air-trap chamber 63*m*, the curvature of the upper portion of the air bubble Ar is smaller than the curvature of the lower portion. Then, the smaller curvature causes the lower resistance related to the surface tension at the time of movement of the air bubble Ar. Thus, the air bubble Ar easily moves upward in accordance with the buoyancy. Thus, air is more easily discharged from the air-trap chambers 63*y*, 63*c*, and 63*m*. Further, a situation is avoided more reliably that air in the air-trap chambers 63*y* and 63*c* and 63*m* enters the head section 20.

Further, the horizontal passage widths of the three air-trap chambers 63*y*, 63*c*, and 63*m* respectively increase stepwise at each bent part from the left end part toward the right end part of the air-trap chamber 63. Thus, when an air bubble is in contact with both side walls of the bent part of each of the air-trap chambers 63*y*, 63*c*, and 63*m*, the curvature of the right side portion of the air bubble becomes smaller than the curvature of the left side portion. Then, the smaller curvature causes the lower resistance related to the surface tension at the time of movement of the air bubble. Thus, the air bubble easily moves toward the air discharge passage 64. Thus, air is more easily discharged from the air-trap chambers 63*y*, 63*c*, and 63*m*.

In order to separate air mixed in the ink from the ink at the time that the ink moves downward, a depth to a certain extent is required. In the present embodiment, in each of the air-trap chambers 63*y*, 63*c*, and 63*m* for three color inks, in addition to the portions where the two outlet ports 65 are formed, the portion between the two outlet ports 65 is also allowed to have a satisfactory depth. Thus, air is allowed to be separated from the ink in a large region of the air-trap chambers 63*y*, 63*c*, and 63*m*. Thus, air mixed in the ink supplied to the head section 20 is allowed to be reduced further.

Further, as described above, the passage length of the air-trap chamber 63*c* for cyan ink is longer than the passage length of the air-trap chamber 63*y* for yellow ink and is shorter than the passage length of the air-trap chamber 63*m* for magenta ink. In the present embodiment, the horizontal passage width of the air-trap chamber 63*c* for cyan ink is smaller than the horizontal passage width of the air-trap chamber 63*y* for yellow ink and is greater than the horizontal passage width of the air-trap chamber 63*m* for magenta ink. Thus, the differences in the volumes of the three air-trap chambers 63*y*, 63*c*, and 63*m* are allowed to be reduced. Further, in the present embodiment, the length of the air-trap chamber 63*c* for cyan ink in the up-down direction is smaller than the length of the air-trap chamber 63*y* for yellow ink in the up-down direction and is greater than the length of the air-trap chamber 63*m* for magenta ink in the up-down direction. Thus, the differences in the volumes of the three air-trap chambers 63*y*, 63*c*, and 63*m* are allowed to be reduced further.

The air-trap chamber 63*m* for magenta ink has a longer passage length than the air-trap chamber 63*y* for yellow ink. Thus, the distance of the air-trap chamber 63*m* for magenta ink through which air is to be moved is longer than that of the air-trap chamber 63*y* for yellow ink. Accordingly, if the kinds of the inks contained in the air-trap chamber 63*m* and the air-trap chamber 63*y* were the same, air discharge becomes more difficult in the air-trap chamber 63*m* than in the air-trap chamber 63*y*. However, in practice, the surface tension of magenta ink is higher than that of yellow ink and hence an air bubble is moved more easily in the magenta ink than in the yellow ink. Thus, the difference in the air discharge performance between the air-trap chamber 63*m* for magenta ink and the air-trap chamber 63*y* for yellow ink is allowed to be reduced.

Next, modifications obtained by variously modifying to the above-described embodiment are described below. Here, like components to those in the above-described embodiment are designated by like numerals and hence their description is not given when appropriate.

1] The distances between the front ends of the four air-trap chambers 63 and the seven outlet ports 65 may be greater than those in the embodiment. For example, the outlet port 65*m*1 may be formed in a portion between the bent part 67*a* and the bent part 67*b* of the air-trap chamber 63*m* for magenta ink.

2] In the embodiment given above, the portion connecting the two outlet ports 65 of each of the air-trap chambers 63*y*, 63*c*, and 63*m* for three color inks is formed such as to protrude to the upstream side of the conveying direction relative to the two outlet ports 65. In contrast, the portion connecting the two outlet ports 65 of each of the air-trap chambers 63*y*, 63*c*, and 63*m* for three color inks may be formed such as to protrude to the downstream side of the conveying direction relative to the two outlet ports 65.

Figure 7:
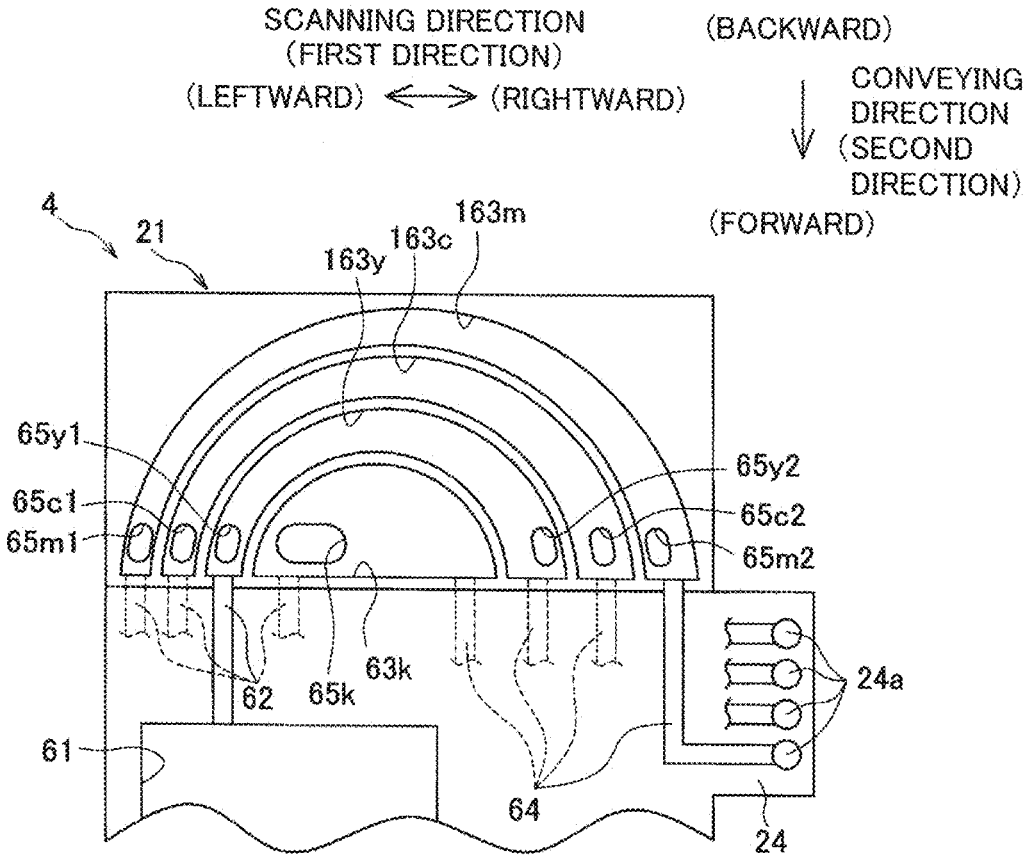
FIG. 7 is a top view of an ink ejection device according to a modification.
Figure 8:
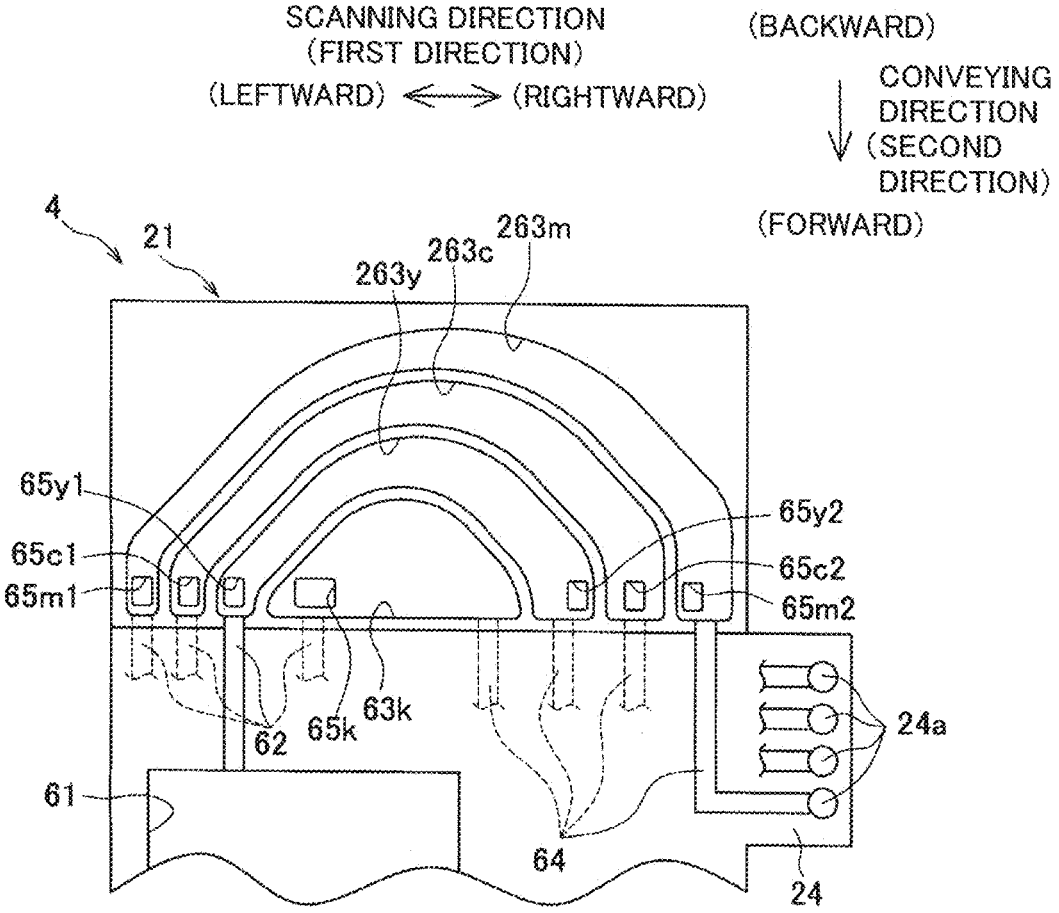
FIG. 8 is a top view of an ink ejection device according to another modification.

3] In the embodiment given above, the portion connecting the two outlet ports 65 of each of the air-trap chambers 63*y*, 63*c*, and 63*m* for three color inks is bent only at obtuse angles in the horizontal plane. In contrast, for example, as illustrated in FIG. 7, the portion connecting the two outlet ports 65 of each of the three air-trap chambers 163*y*, 163*c*, and 163*m* may be bent merely in an arc shape in the horizontal plane. Further, for example, as illustrated in FIG. 8, the portion connecting the two outlet ports 65 of each of the three air-trap chambers 263*y*, 263*c*, and 263*m* may be bent in an arc shape and at obtuse angles in the horizontal plane. Each of the three air-trap chambers 163*y*, 163*c*, and 163*m* in FIG. 7 and the three air-trap chambers 263*y*, 263*c*, and 263*m* in FIG. 8 has a portion extending in a direction intersecting with both of the conveying direction and the scanning direction. Here, the expression that "a part of the air-trap chamber is bent in an arc shape" indicates that the part of the air-trap chamber extends in an arc shape, and does not include a shape that a corner portion is simply formed by R chamfering.

4] In the embodiment given above, in the entire region of the portions 68*b*, 68*c*, and 68*d* of the air-trap chamber 63*m* for magenta ink, the height of the ceiling portion increases toward the air discharge passage 64. In contrast, only in a part of the portions 68*b*, 68*c*, and 68*d*, the height of the ceiling portion may increase toward the air discharge passage 64. Then, the height of the ceiling portion may be at constant in the remaining part of the portions 68*b*, 68*c*, and 68*d*. Similar configurations may be employed in the air-trap chamber 63*y* for yellow ink and the air-trap chamber 63*c* for cyan ink.

5] In the embodiment given above, only in the portions 68*b*, 68*c*, and 68*d* of the air-trap chamber 63*m* for magenta ink, the height of the ceiling portion increases toward the air discharge passage 64. In contrast, in the entire region of the air-trap chamber 63*m* for magenta ink, the height of the ceiling portion may increase toward the air discharge passage 64. Similar configurations may be employed in the air-trap chamber 63*y* for yellow ink and the air-trap chamber 63*c* for cyan ink.

6] In the embodiment given above, the height of the bottom portion of the air-trap chamber 63*m* for magenta ink is at constant. In contrast, the heights of the bottom portions of the portions 68*a* and 68*e*, where the two outlet ports 65*m*1 and 65*m*2 are formed, in the air-trap chamber 63*m* for magenta ink may be lower than the heights of the bottom portions of the portions 68*b*, 68*c*, and 68*d* located between the portions 68*a* and 68*e*. Similar configurations may be employed in the air-trap chamber 63*y* for yellow ink and the air-trap chamber 63*c* for cyan ink.

7] In the embodiment given above, in the entire regions of the air-trap chambers 63*y*, 63*c*, and 63*m* for three color inks in the passage directions (the directions extending in the C-shape) thereof, the air-trap chamber 63 located on the more upstream side of the conveying direction has the smaller length in the up-down direction than the air-trap chamber 63 located on the more downstream side of the conveying direction. In contrast, the air-trap chamber 63 located on the more upstream side of the conveying direction may have the smaller length in the up-down direction only in parts of the air-trap chambers 63*y*, 63*c*, and 63*m* for three color inks in the passage directions.

8] In the embodiment given above, the horizontal passage widths of the air-trap chambers 63*y*, 63*c*, and 63*m* for three color inks increase stepwise at each bent part from the left end part toward the right end part. In contrast, the horizontal passage widths of the air-trap chambers 63*y*, 63*c*, and 63*m* for three color inks may vary continuously in the portions extending linearly.

9] In the embodiment given above, in the entire regions of the air-trap chambers 63*y*, 63*c*, and 63*m* for three color inks in the passage directions (the directions extending in the C-shape) thereof, the air-trap chamber 63 located on the more upstream side of the conveying direction has the smaller horizontal passage width than the air-trap chamber 63 located on the more downstream side of the conveying direction. In contrast, the air-trap chamber 63 located on the more upstream side of the conveying direction may have the smaller horizontal passage width only in parts of the air-trap chambers 63*y*, 63*c*, and 63*m* for three color inks in the passage directions.

10] The positions of the front-side left end parts of the air-trap chambers 63*y*, 63*c*, and 63*m* for three color inks may be not the same in the conveying direction. Further, the positions of the front-side right end parts of the air-trap chambers 63*y*, 63*c*, and 63*m* for three color inks may be not the same in the conveying direction.

11] Each air discharge passage 64 may be connected to a position other than the front-side right end part of each air-trap chamber 63. For example, the air discharge passage 64 may be connected to a position between the two outlet ports 65 and 65 in the ceiling portion of each air-trap chamber 63.

12] Each ink introduction passage 62 may be connected to a position other than the front-side left end part of each air-trap chamber 63. For example, the ink introduction passage 62 may be connected to a position located between the two outlet ports 65 and 65 in the bottom portion of the air-trap chamber 63.

As described above, the above-described embodiment and the modifications thereof are applied to an ink ejection device of an ink jet printer ejecting ink onto recording paper so as to print an image or the like. In addition, the embodiment and the modifications may be applied also to a liquid ejection device used in various applications other than printing of an image or the like. For example, the embodiment and the modifications may be applied also to a liquid ejection device ejecting an electrically conductive liquid onto a substrate so as to form an electrically conductive pattern on a surface of the substrate.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A liquid ejection device comprising:

a liquid ejection section including a plurality of nozzles and being configured to eject a plurality of kinds of liquids, each of the nozzles being configured to eject one kind of liquid among the plurality of kinds of liquids; and a liquid supply section configured to supply the plurality of kinds of liquids to the liquid ejection section, wherein the liquid supply section includes:

two first outlet ports which are separated from each other in a first direction intersecting with a vertical direction and through which a first kind of liquid among the plurality of kinds of liquids flows toward the liquid ejection section;

a first air-trap chamber which communicates with the two first outlet ports and which protrudes to one side of a second direction intersecting with the vertical direction and the first direction relative to the two first outlet ports;

a first liquid introduction passage connected to the first air-trap chamber; and a first air discharge passage connected to the first air-trap chamber, and wherein a portion, connecting the two first outlet ports, of the first air-trap chamber has an arc shape in a plane containing the first direction and the second direction or a bent portion of the portion, connecting the two first outlet ports, of the first air-trap chamber has an obtuse angle in the plane.

2. The liquid ejection device according to claim 1, wherein the first liquid introduction passage is connected to a portion located in an end part on the other side of the second direction of the first air-trap chamber and located in one end part in the first direction of the first air-trap chamber; and the first air discharge passage is connected to a portion located in an end part on the other side of the second direction of the first air-trap chamber and located in the other end part in the first direction of the first air-trap chamber.

3. The liquid ejection device according to claim 2, wherein one end part in the vertical direction of the first air-trap chamber communicates with the two first outlet ports, and the other end part in the vertical direction of the first air-trap chamber is inclined in a direction away from the one end part in the vertical direction of the first air-trap chamber from the one end part in the first direction of the first air-trap chamber toward the other end part in the first direction of the first air-trap chamber.

4. The liquid ejection device according to claim 3, wherein the other end part in the vertical direction of the first air-trap chamber is a celling portion of the first air-trap chamber.

5. The liquid ejection device according to claim 2, wherein a dimension of the first air-trap chamber in the plane and in a direction perpendicular to a passage direction of the first air-trap chamber is larger from the one end part in the first direction of the first air-trap chamber toward the other end part in the first direction of the first air-trap chamber.

6. The liquid ejection device according to claim 1, wherein one end part in the vertical direction of the first air-trap chamber communicates with the two first outlet ports, and a dimension of the first air-trap chamber in the plane and in a direction perpendicular to a passage direction of the first air-trap chamber is larger from the one end part in the vertical direction toward the other end part in the vertical direction.

7. The liquid ejection device according to claim 1, wherein one end part in the vertical direction of the first air-trap chamber communicates with the two first outlet ports, and a vertical position of the one end part in the vertical direction of the first air-trap chamber is constant at least between the two first outlet ports.

8. The liquid ejection device according to claim 7, wherein the one end part in the vertical direction of the first air-trap chamber is a bottom portion of the first air-trap chamber.

9. The liquid ejection device according to claim 1, wherein the liquid supply section further includes:

a second outlet port which is provided between the two first outlet ports and through which a second kind of liquid among the plurality of kinds of liquids flows toward the liquid ejection section;

a second air-trap chamber which communicates with the second outlet port and which is arranged between two portions of the first air-trap chamber in the first direction;

a second liquid introduction passage connected to the second air-trap chamber; and a second air discharge passage connected to the second air-trap chamber.

10. The liquid ejection device according to claim 9, wherein two of the second outlet ports are provided and are separated from each other in the first direction, and the second air-trap chamber protrudes along the first air-trap chamber to the one side of the second direction relative to the two second outlet ports.

11. The liquid ejection device according to claim 10, wherein a dimension of the first air-trap chamber in the plane and in a direction perpendicular to a passage direction of the first air-trap chamber is smaller than a dimension of the second air-trap chamber in the plane and in a direction perpendicular to a passage direction of the second air-trap chamber.

12. The liquid ejection device according to claim 10, wherein a dimension of the first air-trap chamber in the vertical direction is smaller than a dimension of the second air-trap chamber in the vertical direction.

13. The liquid ejection device according to claim 10, wherein the first kind of liquid is magenta ink, and the second kind of liquid is yellow ink.

14. The liquid ejection device according to claim 9, wherein the second liquid introduction passage is connected to a portion located in an end part on the other side of the second direction of the second air-trap chamber and located in one end part in the first direction of the second air-trap chamber, and wherein the second air discharge passage is connected to a portion located in an end part on the other side of the second direction of the second air-trap chamber and located in the other end part in the first direction of the second air-trap chamber.

15. The liquid ejection device according to claim 9, wherein the two portions of the first air-trap chamber are arranged on both sides of the first air-trap chamber in the first direction.

16. The liquid ejection device according to claim 9, wherein a plurality of nozzle groups for ejecting the first kind of liquid and the second kind of liquid include one or plural nozzle(s) of the plurality of nozzles respectively, and the plurality of nozzle groups are symmetrically aligned in the first direction from a central portion of the liquid ejection section in the first direction toward an outer portion of the liquid ejection section in the first direction in an order of the second kind of liquid and the first kind of liquid, and the two first outlet ports and the second outlet port are symmetrically aligned in the first direction.

17. The liquid ejection device according to claim 16, wherein two of the second outlet ports are provided and are separated from each other in the first direction, and the two first outlet ports and the two second outlet port are symmetrically aligned in the first direction from a central portion of the liquid supply section in the first direction toward an outer portion of the liquid supply section in the first direction in an order of the second outlet port and the first outlet port.

18. The liquid ejection device according to claim 1, wherein the plane containing the first direction and the second direction is a horizontal plane.

* * * * *